United States Patent [19]

Stevens, Jr. et al.

[11] 4,341,174

[45] Jul. 27, 1982

[54] BOW DOCK

[75] Inventors: Don L. Stevens, Jr., Arlington; Steven L. Brown, Catharpin; John A. Malone, Falls Church, all of Va.; Timothy A. Knowles, Bradenton, Fla.; Thomas G. Webb, College Park, Md.

[73] Assignee: The United States of America as represented by the Secretary of the Navy, Washington, D.C.

[21] Appl. No.: 142,796

[22] Filed: Apr. 22, 1980

[51] Int. Cl.[3] ..... B63C 1/02

[52] U.S. Cl. ..... 114/45; 114/47

[58] Field of Search ..... 114/44, 45, 47, 48, 114/248, 259, 260; 405/4, 5, 6; 49/381, 383, 476

[56] References Cited

U.S. PATENT DOCUMENTS

| | | | |
|---|---|---|---|
| 326,985 | 9/1885 | Howes | 61/68 |
| 570,480 | 11/1896 | Marsden | 114/45 |
| 1,617,990 | 2/1927 | Donnelly | 114/45 |
| 1,682,091 | 8/1928 | Rathke | 49/208 |
| 2,360,690 | 10/1944 | Koulichkov | 61/68 |
| 3,326,162 | 6/1967 | King | 114/45 |
| 3,364,895 | 1/1968 | DeJong et al. | 114/259 |
| 3,486,476 | 12/1969 | Breit | 114/248 |
| 3,826,384 | 7/1974 | Cecce | 114/260 |
| 3,842,781 | 10/1974 | Kikui | 114/248 |
| 3,926,002 | 12/1975 | Luduigsson | 405/5 |
| 3,939,614 | 2/1976 | Frommelt et al. | 49/477 |
| 4,026,234 | 5/1977 | Zbilut et al. | 114/248 |
| 4,084,528 | 4/1978 | Itani et al. | 114/45 |

FOREIGN PATENT DOCUMENTS

| | | | |
|---|---|---|---|
| 2141258 | 3/1973 | Fed. Rep. of Germany | 405/6 |
| 419217 | 11/1934 | United Kingdom | 405/4 |
| 1169295 | 11/1969 | United Kingdom | 114/45 |

*Primary Examiner*—Trygve M. Blix
*Assistant Examiner*—Thomas J. Brahan

[57] ABSTRACT

A bow dock for use in a two-step docking method to allow the repair or replacement of a sonar-dome rubber window on a variety of classes of full draft vessels in harbors and other water of limited depth. The bow dock is provided with docking pedestals and alignment fenders which mate with docking brackets and fenders on the vessel to be docked. Each docking pedestal is provided with an electronic load cell to monitor the pedestal load during docking. The stern gate is fitted with an auxiliary gate and inserts designed to mate with the hull configuration of each vessel class. The stern gate is also provided with a slotted pivot hinge to facilitate sealing of the stern gate to the dock by hydrostatic pressure.

19 Claims, 14 Drawing Figures

DOCKING CYCLE - PREPARATION

DOCKING CYCLE - BALLASTED

DOCKING CYCLE - ENTRY

BOW DOCK

BACKGROUND OF THE INVENTION

The present invention relates to a bow dock for use in a two-step docking method to allow the repair or replacement of a sonar dome rubber window on full-draft vessels, or to allow other repair work on the bow portion of these vessels.

A bow dock, or partial floating dry dock, is used to provide a water-free work space around the underwater bow and attendant hull area of a full-draft waterborne vessel. Providing such a work space eliminates the necessity, expense, and time of dry docking the entire vessel to perform routine maintenance on the vessel's sonar dome, or to perform other routine or emergency work on the bow portion of the vessel.

The operation of the bow dock parallels the operation of a conventional floating dry dock except that the physical interaction between the bow dock and vessel is different. A conventional floating dry dock must have a lifting capacity greater than the weight of the vessel so that the dry dock can lift the vessel out of the water. The bow dock does not lift the vessel but instead surrounds the bow and mates with the vessel thus creating a dry and structurally safe work place at the bow of the vessel. The bow dock transmits to the vessel a force sufficient to seal the bow dock with the vessel.

Prior-art bow docks include cofferdam type docks, such as that shown by Howes, U.S. Pat. No. 326,985, or Koulichkov, U.S. Pat. No. 2,360,690, wherein the vessel is positioned in the cofferdam and a seal is created between the hull and cofferdam by means of pivoting or telescoping arms covered with a waterproof shield or apron. The vessel is supported in the cofferdam by keel blocks positioned under the vessel. Other bow docks have been proposed wherein the seal is formed between the dock and the vessel by means of an inflated bladder configured to the hull shape of the vessel. One disadvantage of these docks is that a safe, watertight seal cannot be attained between the dock and the vessel, especially where the dock is to be adapted to numerous classes of vessels.

Another prior-art bow dock, disclosed by King, U.S. Pat. No. 3,326,162, is designed to be used in a one step method of docking a vessel under construction so as to allow the sonar dome to be attached to the vessel. This type dock forms the seal between the dock and the vessel by pivoting a stern gate from the horizontal to the vertical and mating with the hull configuration. The disadvantage of this type dock in draft constrained water is that it can be used only on vessels with a light draft-that can be docked by a one step method of warping the vessel and dock together and then raising the stern gate. On vessels that are fully operational and consequently have a deeper draft, this type of dock and method cannot be used because when the vessel and dock are moved completely together the stern gate of the dock cannot be pivoted to mate with the hull due to the increasing size of the hull. When the vessel is riding deeper in the water, more of the flared portion of the hull is in the water. For the stern gate to form a seal, it must pivot up and forward with respect to the hull and pass by a portion of the hull which is wider than the opening in the stern gate before it reaches the narrower portion of the hull where it is to affect the seal. Because the stern gate opening is smaller than the mid-portion of the hull, the stern gate cannot pivot past the wide portion of the hull to seal with the narrow portion of the hull and thus this type of dock cannot be used with full draft vessels in limited depths of water.

SUMMARY OF THE INVENTION

Accordingly, in the present invention there is provided a bow dock for use in a one-step or two-step docking method to allow the repair or replacement of a sonar dome rubber window.

The bow dock is of the cofferdam type with a stern gate and a central well. The well is provided with aligning fenders, and docking pedestals, both of which extend into the well. The aligning fenders guide corresponding vessel fenders when the vessel and bow dock are warped together. The dock pedestals mate with docking brackets on the vessel and transmit the sealing load from the dock to the vessel. Each pedestal is equipped with an electronic load cell to monitor the load at each pedestal. The dock aligning fenders have intermediate stops for positioning the vessel during the first step of the two step method.

The stern gate of the bow dock is provided with interchangeable inserts, each insert designed to mate with a particular hull configuration and seal the gate against the vessel. The inserts enable the bow dock to be used with several classes of vessels. The stern gate is also provided with an auxiliary gate which facilitates changing of the stern gate insert. The stern gate is pivoted to the bottom of the cofferdam by means of a slotted hinge which facilitates sealing of the stern gate against the dock by hydrostatic pressure.

In operation, the vessel to be docked is mated with the bow dock in a two step method. After the dock has been ballasted down, the vessel and dock are warped together until the vessel fenders reach the intermediate stops at which point the sonar dome will have passed by and over the stern gate which can then be pivoted into the vertical position without interference from the hull configuration. The stern gate is then latched into position and sealed against the bow dock.

In the second step, the vessel and dock are warped together until the dock pedestals are aligned with the vessel brackets and the bow dock is deballasted until the load cells indicate the desired load per pedestal. At this point the hull has mated with and has sealed against the stern gate. The well is then dewatered to provide a dry and structurally safe work space for performing maintenance on the vessel's sonar dome rubber window, or for performing other maintenance on the bow portion of the vessel.

OBJECTS OF THE INVENTION

It is therefore an object of the present invention to provide a bow dock that creates a dry working space around the bow of a vessel to allow maintenance of the sonar dome.

Another object is to provide a bow dock that can be used to perform maintenance on the sonar domes of a variety of classes of vessels in harbors and other water of limited depth.

Another object is to provide a bow dock that can be used to perform routine or emergency repairs on the bow portion of a vessel.

Still another object is to provide a bow dock which allows maintenance to be performed on a vessel's sonar dome without the necessity of dry docking the entire vessel.

Yet another object is to provide a bow dock that creates a dry working space around the bow of an operational vessel having a full-load draft.

A further object is to provide a bow dock which allows maintenance to be performed on the sonar dome rubber window of an operational vessel having a full-load draft without the necessity of dry-docking the entire vessel.

A still further object is to provide a two step method of docking in a bow dock a fully operational vessel with a full-load draft.

Other objects, advantages and novel features of the present invention will become apparent from the following detailed description of the invention when considered in conjunction with the accompanying drawings.

BRIEF DESCRIPTION OF THE DRAWINGS

A more complete appreciation of the invention and many of the attendant advantages thereof will be readily understood by reference to the following detailed description when considered in conjunction with the accompanying drawings in which like numerals designate like parts throughout the figures and wherein.

DESCRIPTION OF THE PREFERRED EMBODIMENT

Figure 1:
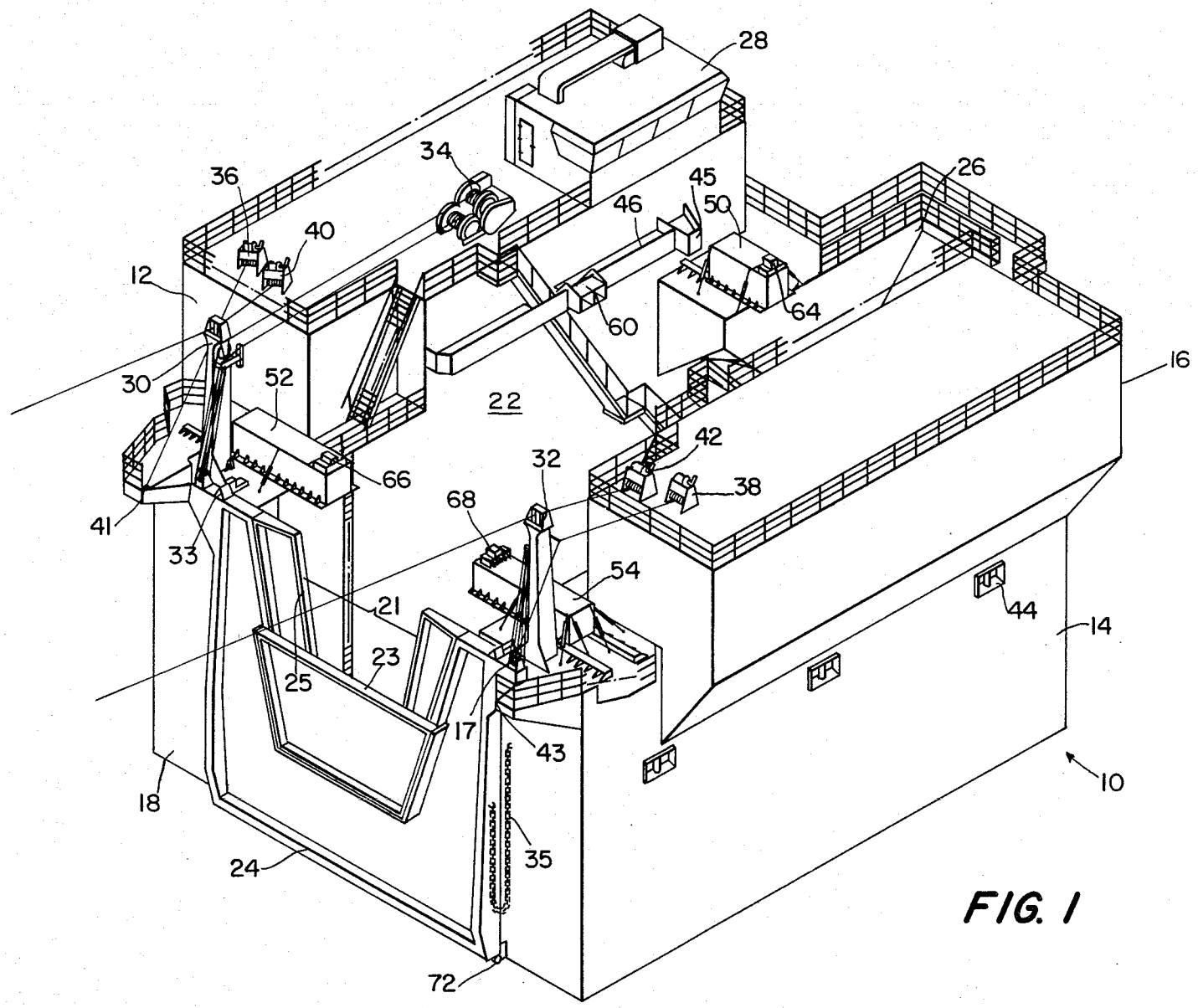
FIG. 1 shows an isometric view of the bow dock according to the present invention.

Referring to FIG. 1, there is illustrated a bow dock 10 with port and starboard side members, 12 and 14, respectively. The side members encompass the port and starboard ballast tanks (not shown). The bow dock has a standard ballast system of fixed piping, sea suctions, ballast pumps, valve manifolds and overboard discharges for ballasting or deballasting the ballast tanks and flooding or dewatering the bow dock well. The bow dock is also provided with a bow end 16 and stern end 18 which, together with the port and starboard side members, are mounted on bottom structure 20, shown in FIG. 6, to form an enclosed well 22. The stern end of the bow dock is provided with a stern gate 24 which is pivotally attached to the bottom structure, while the bow-end of the dock is formed with a vessel bow receiving section 26. The stern gate permits the vessel which is to be docked to pass into the bow-dock while the bow receiving section receives the bow of the vessel when the vessel is mated with the dock.

The port side member of the bow dock has a central control station 28 from which the bow dock operator can control and monitor the docking operation. The central control station has remote monitoring means for the ballast pumps, ballast tanks, sea suctions, overboard discharges, stern-gate-opening alarm and electronic load cells, which monitor the sealing force between the vessel and the bow dock. The load cells are equipped with both high and low load alarms which can be monitored in the central control station.

Port and starboard kingposts 30 and 32, respectively, are positioned on the side members adjacent the stern gate to facilitate raising and lowering of the stern gate by means of cables rigged between the gate and a main stern gate winch 34. The bow dock has a variety of cable blocks which may be used in conjunction with the kingposts and cables for raising or lowering the stern gate. Winch 34 is used to raise the gate and brake the lowering of the gate after the port and starboard auxiliary stern gate winches 36 and 38, respectively, have broken the seal between the gate and the dock by pulling the gate away from the bow dock, as will be discussed later. The auxiliary stern gate winches are each positioned on the port and starboard side members, respectively, so as to be adjacent the port and starboard kingposts. The cables from winches 36 and 38 are rigged from the winches, through blocks 41 and 43, respectively, which project astern of the stern gate, and then to the stern gate itself. This allows the winches to exert an aftward force against the stern gate when it is necessary to open the stern gate.

Directly inboard from the auxiliary winches are port and starboard warping winches 40 and 42, respectively, which are used to facilitate mating of the bow dock and vessel by warping them together. The outboard sides of the port and staboard side members are provided with several bitts 44 which can be used both to moor the bow dock or facilitate mating of the bow dock with the vessel.

The dock well is furnished with docking fenders 46 and 48, located on the port and starboard sides of the well, respectively, (only fender 46 is visible in the drawings). Each of the dock fenders supports an intermediate stop 60 and 62, respectively, which are used for positioning the vessel in the bow dock during the two-step docking method (stop 62 is not visible in the drawing). The intermediate stops are pivotally attached to the fenders to allow the stops to be raised when it is necessary to move the vessel further into the bow dock.

Also positioned in the dock well are adjustable docking pedestals 50, 52, 54, and 56 which are mounted to project into the well so as to support the vessel when it is mated with the dock (pedestal 56 is not visible in the drawings). The docking pedestals are adjustable in a transverse direction, which enables the dock to be used with a variety of ship classes, and are secured in the desired position by means of turnbuckles. Each pedestal is provided with an electronic load cell 64, 66, 68, and 70 each of which is positioned so as to monitor the load between the pedestal and the docking brackets which are rigidly attached to the vessel (cell 70 is not visible in the drawing). The load cells are monitored by the dock operator at the central control station.

Figure 7:
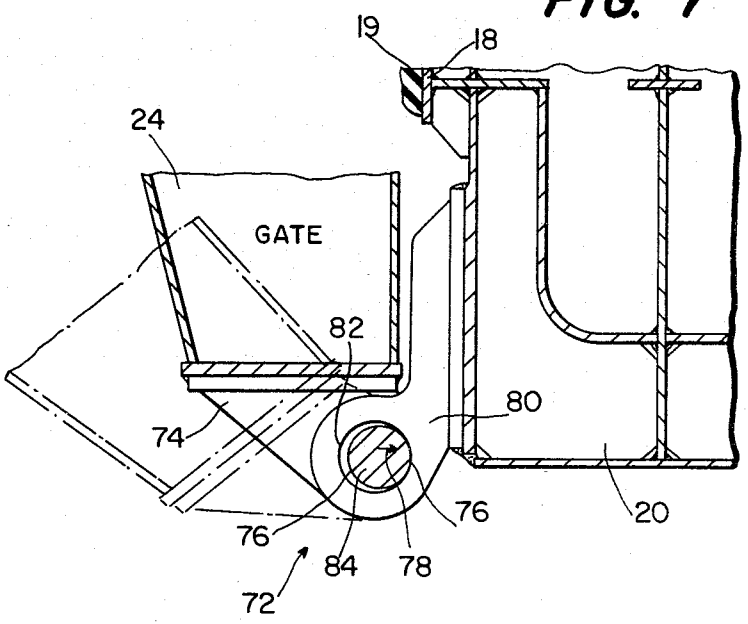
FIG. 7 shows an enlarged cross-sectional view of the stern gate hinged to the bow dock taken along line 7—7 of FIG. 5.
Figure 8:
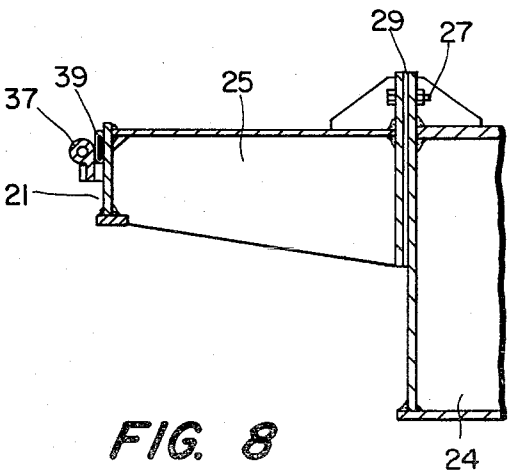
FIG. 8 shows an enlarged cross-sectional view of the stern gate and insert taken along line 8—8 in FIG. 5.
Figure 6:
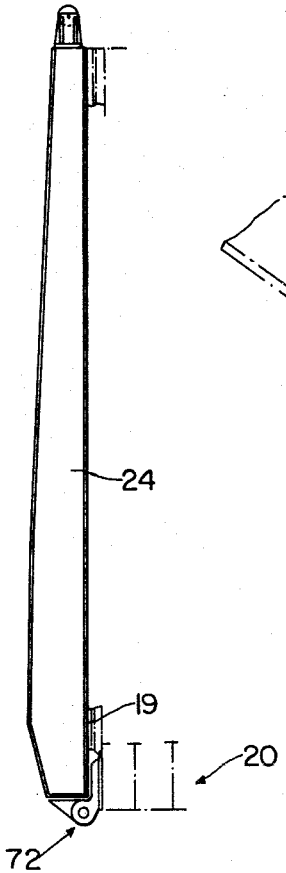
FIG. 6 shows a side elevation view of the stern gate in the closed position attached to a portion of the bow dock.
Figure 5:
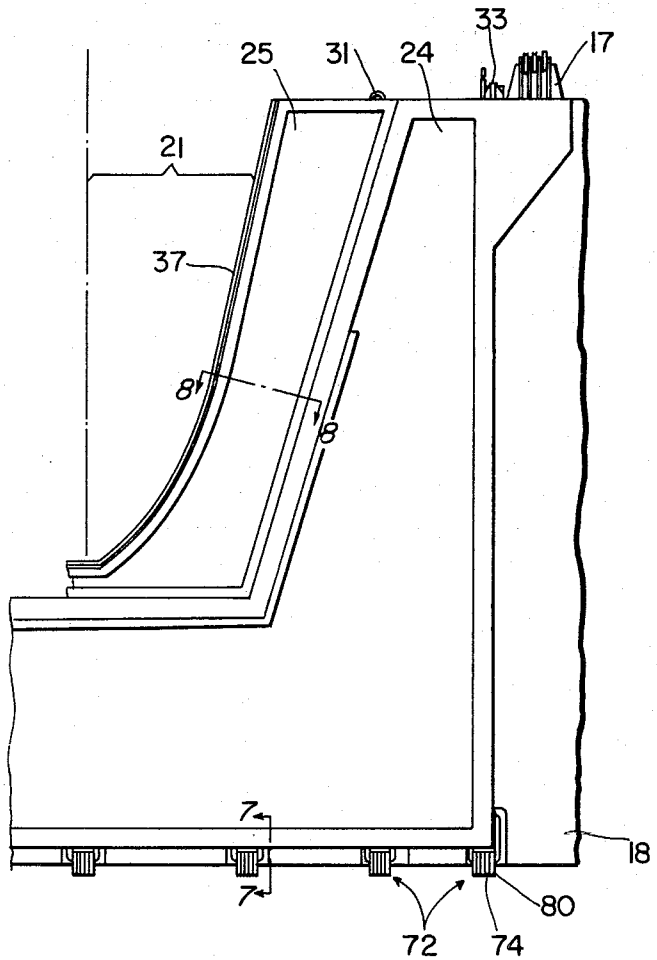
FIG. 5 shows a front elevation view of a portion of the stern gate and bow dock.

As illustrated in FIG. 1, and further illustrated in FIGS. 5 through 7, stern gate 24 is pivotally hinged to the bottom structure 20 by a plurality of hinge assemblies 72. The stern gate has a trapezoidal-shaped indentation in which is removably fitted a stern gate insert 25. As illustrated in FIG. 8, the insert fits in the trapezoidal indentation of the stern gate and is bolted to the gate by a plurality of threaded fasteners 27. A gasket material 29 is provided between the insert and the gate to affect a watertight seal between the insert and the gate. The stern gate insert is shaped with an identation 21, shown in FIG. 1, which mates with the hull configuration of a particular class of vessel to be docked. Each class of vessel requires a distinct indentation that is shaped for its hull configuration. The indentation is provided with a J-seal 37, shown in FIG. 8, which forms a seal between the hull and the insert. The seal 37 has a back-up sealing means in the form of a deflated fire hose 39 which, when energized by a fire main, can increase the sealing force of the J-seal. Each insert is also provided with eyelets 31, shown in FIG. 5, which facilitate positioning of the insert in the stern gate by means of a dockside crane.

To facilitate changing the stern gate insert, the stern gate is also fitted with an auxiliary gate 23, shown in FIG. 1, which also is positioned in the trapezoidal indentation outboard of the stern gate insert. The auxiliary gate is attached to the stern gate by lowering it into a guide track integral with the stern gate (not shown). The auxiliary gage is positioned in the trapezoidal indentation of the stern gate while the stern gate insert is changed and after the vessel is undocked so as to enable the well to be dewatered.

As illustrated in FIG. 5, the top of the stern gate is fitted with latching members 33, which lock the stern gate in the vertical position against the stern end after the gate is raised. Stationary tackle blocks 17 are also positioned on the top of the stern gate on both port and starboard sides. The cables from main winch 34 or auxiliary winches 36 and 38 are reeved through blocks 17 for raising or lowering of the stern gate. As shown in FIG. 6, the stern end of the dock is fitted with a gasket 19 which creates a watertight seal between the stern end and the stern gate when the gate is in the vertical position. Chain stops 35, shown in FIG. 1, are positioned on either side of the stern gate and are attached between the gate and the stern end so as to stop the pivoting of the stern gate after it reaches a fully lowered position.

Referring now to FIG. 7, there is illustrated an enlarged cross-sectional view of a hinge assembly 72 attaching stern gate 24 to bottom structure 20. The stern gate has a plurality of hinge members 74 each of which has a cylindrical hole 76. The bottom structure 20 is fitted with a plurality of hinge members 80 each of which has a hole 82 elongated with respect to direction 78. In each hinge assembly 72, gate hinge members 74 interfit alternately with the bottom structure hinge members 80, as shown in FIG. 5, and pin 84 is slidingly inserted into cylindrical holes 76 and elongated holes 82 so as to pivotally attach the stern gate to the bottom structure. Pin 84 is cylindrical in shape and when fitted into cylindrical holes 76 and elongated holes 82, permits the gate to move slightly in direction 78. The slight movement of the stern gate allows the gate to be sealed against gasket 19 by the hydrostatic force of the water outside of the dock and thus provides for a watertight seal between the stern gate and the stern end of the dock. It is contemplated that the stern gate can also be slidingly mounted on the stern end of the bow dock (not shown).

To enable a vessel to be docked in the bow dock, the designated vessel must be fitted with vessel fenders, which align with the dock fenders, and docking brackets which mate with the docking pedestals and transmit the sealing load from the dock to the vessel.

Figure 2:
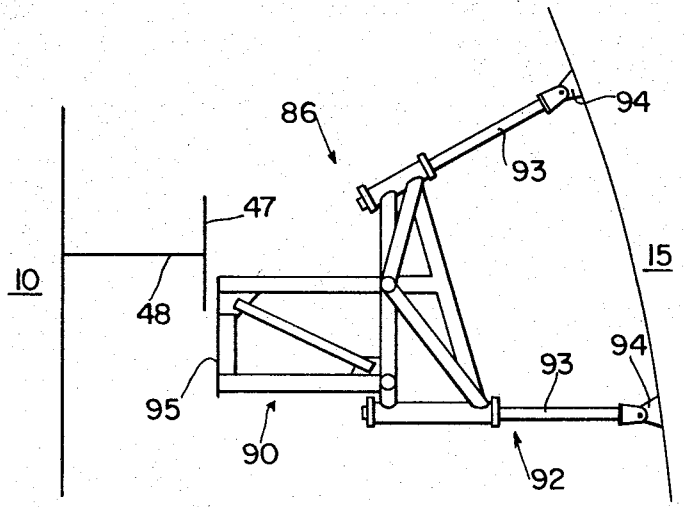
FIG. 2 shows a schematic front view of the starboard vessel fender aligning with the starboard bow dock fender.
Figure 3:
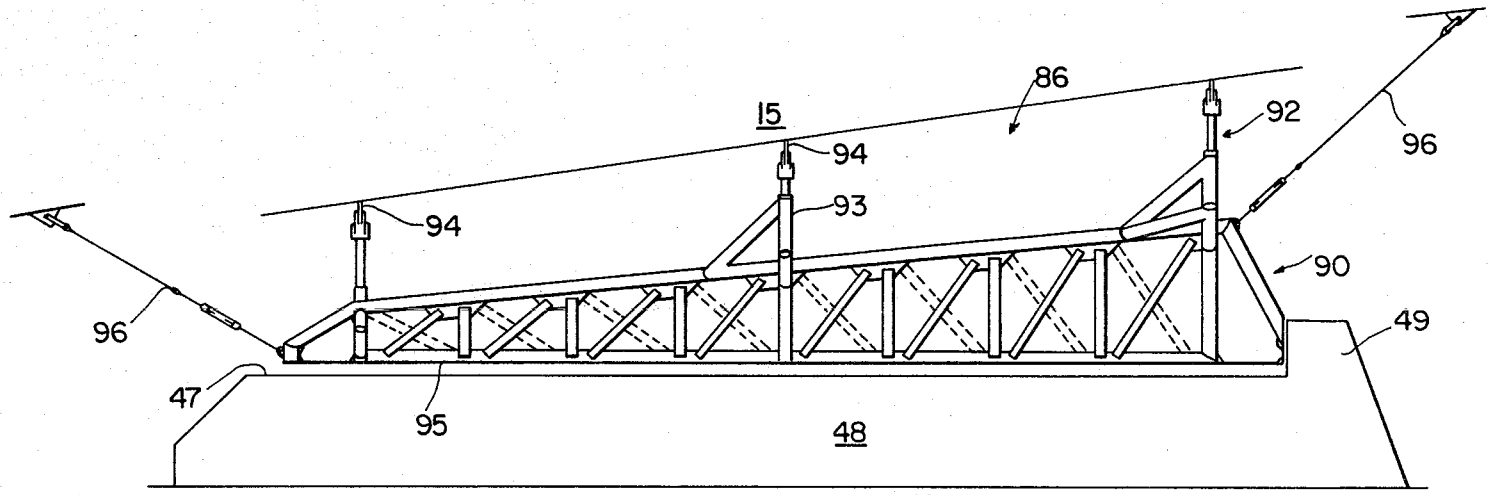
FIG. 3 shows a schematic plan view of the starboard vessel fender aligned with the starboard bow dock fender.

Referring to FIG. 2 there is shown in schematic form a front view of the vessel and dock fenders, looking astern, and referring to FIG. 3, there is shown a plan view of the starboard vessel fender aligning with the starboard dock fender. The vessel to be docked is fitted with port and starboard fenders 88 and 86, respectively. Each dock fender is constructed with a fender portion 90 and a support portion 92. The support portion of the fender is a plurality of upper and lower telescoping arms 93 which are attached to the vessel hull by padeyes 94 welded to vessel hull 15. The telescoping arms are adjustable to enable the vessel fenders to be used with the various classes of vessels to be docked in the bow dock. The fender portion of the vessel fenders is provided with a face 95 which aligns parallel with face 47 of the dock fenders so as to guide the vessel into the bow dock. The dock fenders are constructed with final stops 45 and 49, shown in FIGS. 1 and 3, for longitudinal positioning of the vessel in the bow dock. The vessel fenders are also attached to the vessel by a plurality of stays 96 shown in FIG. 3, which absorb impact forces in the longitudinal direction.

Figure 4:
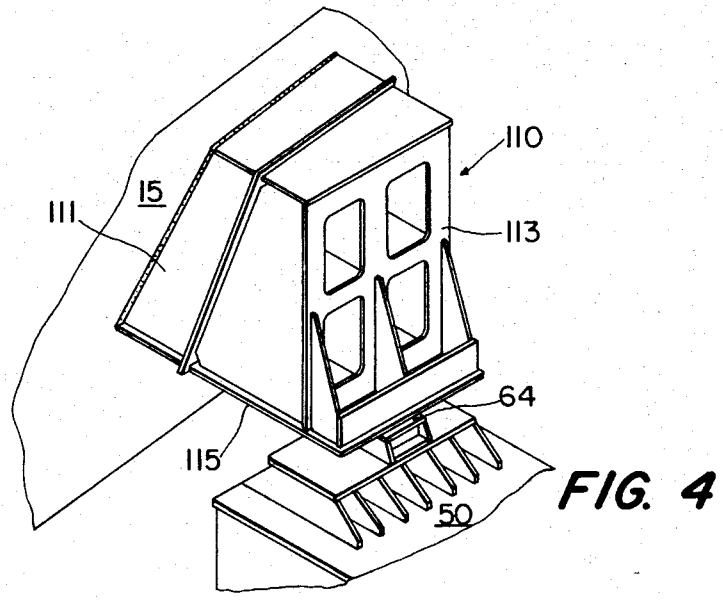
FIG. 4 shows an isometric view of a typical vessel docking bracket engaged with a typical docking bracket pedestal.

The vessel to be docked is also provided with docking brackets 110, 112, 114 and 116 positioned on the port and starboard sides of the vessel, both forward and aft of the vessel fenders. FIG. 4 illustrates port forward docking bracket 110 in relation to port forward docking pedestal 50 after the vessel and the bow dock have been warped together. The docking bracket is constructed with an adaptor portion 111 attached to a pedestal-engaging portion 113. The adaptor portion is a hollow box which is shaped by cutting to fit the particular hull configuration of the vessel to be docked. With each docking, the adaptor is shaped to fit the vessel to be docked and welded to the hull until, after a number of dockings, the adaptor portion has been reduced to the extent that replacement is required. The pedestal engaging portion of the docking bracket has a pedestal engaging surface 115 which abuts electronic load cell 64 of pedestal 50 when the vessel is mated with the bow dock.

Figure 9:
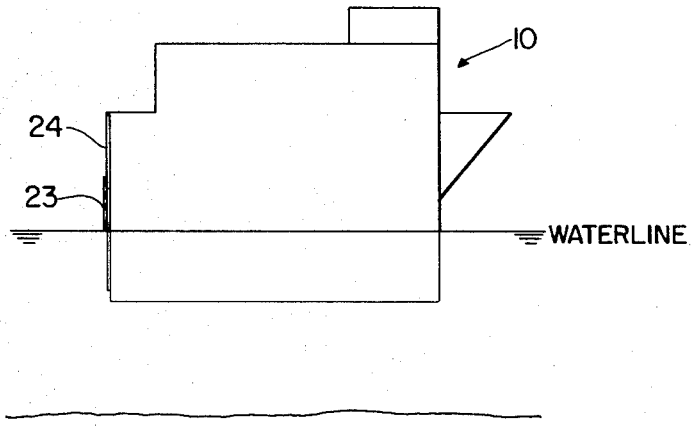
FIGS. 9–14 shows the sequence of operation of the bow dock using the two step method of docking.

The operation of the bow dock in docking a vessel by the two-step docking method is diagrammatically illustrated in FIGS. 9–14. FIG. 9 illustrates the bow dock in a deballasted condition with the dock floating high in the water and with stern gate 24 in the vertical position. Auxiliary gate 23 is in place to preserve the watertight integrity of bow dock well 22 and the stern gate insert 25 is then positioned in the stern gate. The insert is shaped with a hull configuration indentation which fits the hull of the particular class of vessel to be docked. Once the insert is positioned in and partially fastened to the stern gate by means of threaded fasteners 27 (see FIG. 5), the auxiliary gate is removed and fastening of the insert to the stern gate is completed. At this time the bow dock is prepared for entry of the vessel to be docked by replacing the auxiliary gate and by positioning the pedestals and intermediate stops to accommodate the particular vessel being docked.

With the auxiliary gate replaced and the stern gate insert in position, the bow dock is ballasted down in the water by means of the ballasting system which pumps seawater into the well until the interior well level and exterior level are equal. Then the auxiliary gate is removed utilizing an exterior source (crane, for example) and the bow dock is further ballasted down by pumping seawater into the ballast tanks. Because of the shape of the bow dock the tanks are not the same size and shape and thus have different capacities. The bow dock operator must monitor the trim of the bow dock and adjust the pumping rate to the individual tanks as required. When the bow dock is ballasted down in the water to approximately the vessel insertion draft for the particular vessel to be docked, the ballasting is terminated.

Figure 10:
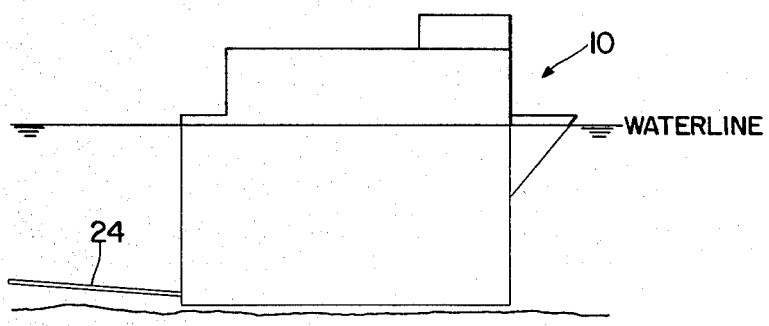
Figure 11:
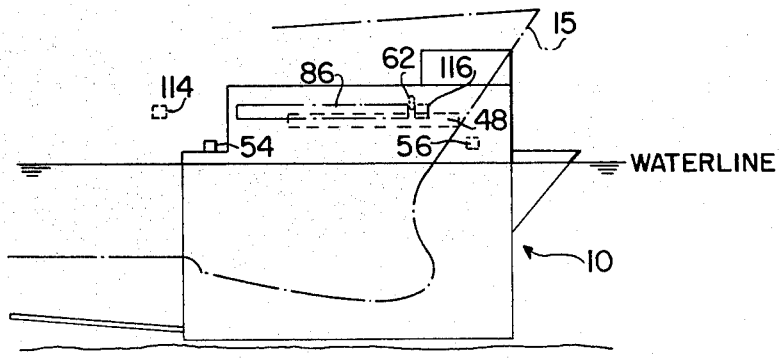
Figure 12:
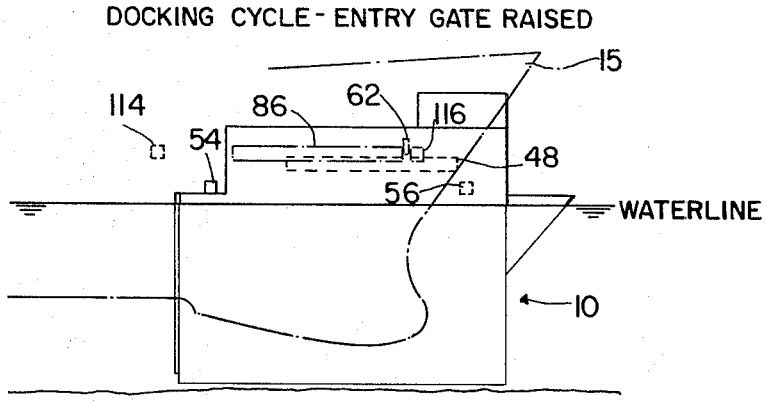

Stern gate latches 33, shown in FIGS. 1 and 5, are then unlatched from the stern end of the bow dock and the port and starboard auxiliary stern gate winch cables are rigged from the winches, through blocks 41 and 43, and to the port and starboard sides of the stern gate away from the stern end of the bow dock and break the seal between the gate and the bow dock. After the gate is initially opened by the auxiliary winches, main stern gate winch 34 is used to brake the lowering of the gate until it reaches the fully lowered position, as shown in FIG. 10, where it is stopped by chain stops 35. When the stern gate is opened, further ballasting and trim adjustments may be performed by the operator of the bow dock. FIG. 10 illustrates the bow dock ballasted to the vessel insertion draft with the stern gate in the open position and ready to receive the vessel.

Before the vessel and bow dock are warped together, vessel fenders 86 and 88 and vessel docking brackets 110, 112, 114 and 116 must be positioned on the port and starboard sides of the vessel. Both the padeyes for the fenders and the bracket adaptors are welded to the hull. The positioning of the vessel fenders and docking brackets is accomplished by referring to the design plans of the class of vessel to be docked. The vessel positions for the fenders and brackets correspond to the positions of the dock fenders and pedestals.

With the vessel prepared for docking, the bow dock is aligned with the vessel adjacent to a shore facility and the warping winch cables are attached to the vessel and used to warp either the vessel into the bow dock or the bow dock onto the bow of the vessel.

During this first step, the vessel and dock are brought together until the vessel fenders reach intermediate stops 60 and 62 which have been pre-positioned on the dock fenders. When the intermediate stops are reached the vessel sonar dome will have passed the stern end (i.e., sill) of the bow dock but the vessel will not have entered the dock to the extent that the flare of the hull configuration interferes with the pivoting of the stern gate into the vertical position. The vessel is within the bow dock to the extent indicated in FIG. 11.

With the vessel in the dock, stern gate 24 is raised to the vertical position by the main stern gate winch and latched to the stern end of the bow dock by the stern gate latches. At this time the hull configuration indentation of the stern gate insert does not mate with the vessel hull because the vessel is not in the final docking position. The dock, with the stern gate in the vertical position, is shown in relation to the vessel in FIG. 12.

Prior to the second step of the two-step docking method, the intermediate stops are removed as a barrier to the further engagement of the vessel and the dock. This is done by using portable chain falls (not shown) to raise the stops up above the dock fenders. Due to the positioning of the sonar dome on some classes of vessels the intermediate stops may have to be removed prior to raising of the stern gate so that the vessel and bow dock may be engaged sufficiently to let the sonar dome clear the stern end of the bow dock. If this becomes necessary, a temporary intermediate stop may be constructed by welding eyelets to both the vessel and the bow dock and connecting the eyelets with chains of the correct length to act as a stop.

Figure 13:
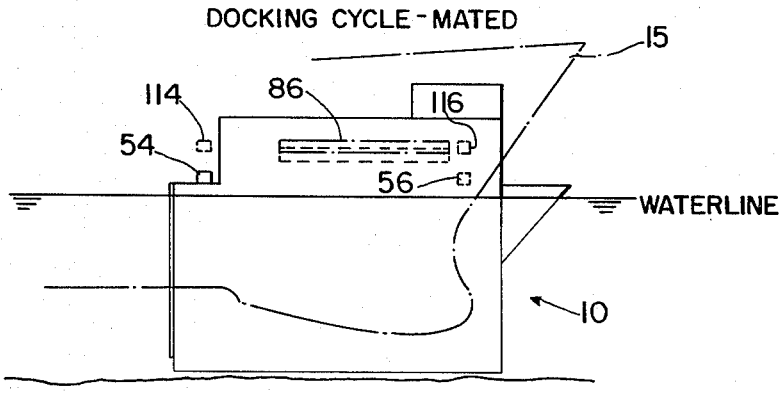

The second step of the two-step method is illustrated in FIG. 13. The vessel and the dock are warped together until the vessel fenders have reached final stops 45 and 49, see FIG. 3. At this point the docking brackets of the vessel are aligned with and directly above the docking pedestals of the bow dock. The hull configuration of the vessel has not yet mated and sealed with the J-seal on the hull configuration indentation of the stern gate insert.

To complete the mating between the vessel and the bow dock, the dock is deballasted and raised by pumping water from the ballast tanks to the sea until the vessel docking brackets are seated on the electronic load cells of the docking pedestals. The dock is deballasted until the desired initial load is attained on each pedestal. When the aft vessel docking brackets contact the aft docking pedestals, the vessel's hull configuration seals against the J-seal of the hull configuration indentation of the stern gate insert. Deballasting is continued until the load cells show a desired load of 10 tons, for example, on each docking pedestal.

Figure 14:
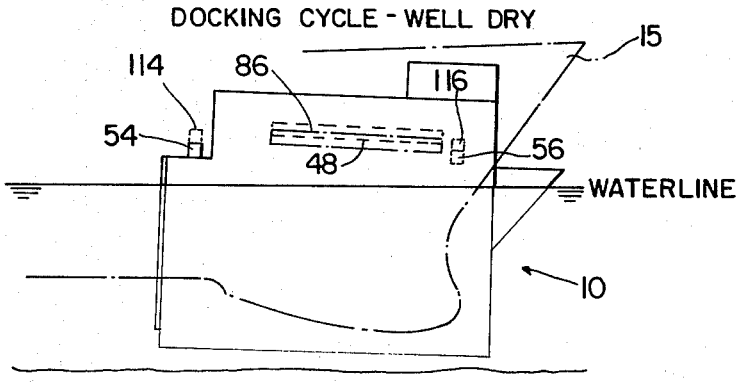

The relative positions of the vessel and bow dock after desired loading of the pedestals are illustrated in FIG. 14. It is to be understood that all desired pedestal loads will vary dependent upon the actual loading and class of a particular vessel.

After the vessel and bow dock have been mated using the two-step method, the well of the bow dock must be dewatered to provide a work area around the sonar dome. The process of dewatering the well is not a straight-forward procedure accomplished simply by pumping the water in the well to the sea because of the relationship between the lost buoyancy of the portion of the vessel within the bow dock and the load transmitted between the bow dock and the vessel.

The ballasting system is used to pump water from the well to the ballast tanks while the electronic load cells are monitored. When the load on the cells enters a set range, between 55 and 60 tons, for example, the ballast system must be realigned to pump seawater from the harbor into the ballast tanks to decrease the buoyancy of the dock and the loading on the load cells. When the loading is reduced below the set range, between 45 and 50 tons, for example, the ballast system is again realigned to dewater the well by pumping from the well to the ballast tanks. This procedure is repeated until the well is completely dewatered. If during the dewatering process the load is allowed to be greater than an upper limit, 60 tons, for example, or less than a lower limit, 40 tons, for example, on any load cell, the load cell alarm will sound denoting under or over pressure at a specific load cell.

With the well dewatered the hydrostatic pressure of the water acting against the stern gate forces the gate against gasket 19, shown in FIGS. 6 and 7, on the stern end of the bow dock. Slotted hinge assembly 72 of the stern gate enables the gate to move and seal against the gasket thus providing a safe, watertight area for performing maintenance on the rubber window of the vessel sonar dome or bow portion of the vessel. If a complete watertight seal is not formed, hose 39, illustrated in FIG. 8, may be energized to provide additional sealing force between the vessel and the stern gate insert.

After the maintenance of the sonar dome or bow portion of the vessel has been completed, the unmating of the vessel and bow dock may be accomplished by reversing the above procedure. The only variation in this process is the use of an adjustable separation stop (not shown) for positioning the vessel between the steps of the two-step method. The separation stop may be a chain of the desired length connected between pins welded to the vessel fender and the bow dock. After unmating, the vessel and bow dock are moved apart by external means, a winching mechanism on the shore facility, for example. The auxiliary gate is then repositioned in the stern gate, the well is dewatered, and the bow dock is deballasted.

It is thus apparent that the present invention provides a bow dock that affords a dry working space around the bow of a vessel so as to allow maintenance of a sonar dome rubber window on a fully operational vessel with a full-load draft without the disadvantages of dry-docking the entire vessel. The bow dock is used in a two-step docking method that allows entry of an operational vessel's sonar dome while also allowing the stern gate to be raised without interference from the flared hull configuration.

Many obvious modifications and embodiments of the specific invention other than those set forth above, will readily come to mind to one skilled in the art having the benefit of the teachings presented in the foregoing description and the accompanying drawings of the subject invention and hence it is to be understood that such modifications are included within the scope of the appended claims.

What is claimed is:

1. A bow dock providing a dry work space for performing maintenance on the bow of a vessel, comprising:

a bottom structure;

a stern end mounted on the bottom structure, said stern end having an aperture for receiving the bow of the vessel;

a bow end mounted on the bottom structure;

port and starboard side members mounted on the bottom structure to form a well with the bow and stern ends;

a stern gate mounted on the stern end of the dock so as to close the stern end aperture, said stern gate comprising:

means conforming the stern gate to the vessel hull, said means being formed with indentations shaped complementarily to the shape of the hull at a predetermined location along the hull, and means forming a seal between the conforming means and the vessel hull;

means mounted on facing sides of both vessel and dock for controlling both the longitudinal and transverse positions of the vessel within the dock's well, said position-control means being configured to determine the vessel's longitudinal and transverse positions in at least two locations in the well, one of said locations being defined as an intermediate stop means which is removed when the vessel is moved to the second of said two locations; and means supporting the vessel in the well.

2. A bow dock as in claim 1 wherein:

said position control means and the dock together includes intermediate and final stop means, the intermediate stop means being at a location which permits the bow of the vessel to be brought into the dock to a desired position at which the stern gate can be raised to its vertical position without interference from the transverse-section dimension of the vessel's hull.

3. A bow dock as in claim 2 wherein the intermediate stops are pivotally attached to the position control means.

4. A bow dock as in claim 1 wherein the stern gate further comprises means closing the conforming means when the vessel is not in the dock.

5. A bow dock as in claim 1 wherein the stern gate further comprises means forming a seal between the stern gate and the stern end of the bow dock.

6. A bow dock as in claim 5 wherein the means forming a seal between the stern gate and the stern end comprise:

a compressible means positioned between the stern gate and the stern end; and a hinge and hinge pin pivotally mounting the stern gate to the stern end, said hinge having a hinge pin aperture elongated in a direction which allows the stern gate to move against the compressible means when hydrostatic forces act against the stern gate.

7. A bow dock as in claim 1 wherein the port and starboard side members have means moving the vessel into the dock.

8. A bow dock as in claim 1 wherein the dock has means ballasting and deballasting the dock and dewatering the well.

9. A bow dock as in claim 1 wherein the dock is provided with a central control station.

10. A bow dock as in claim 1 wherein the means supporting the vessel comprise:

a plurality of vessel brackets;

a plurality of transversely adjustable pedestals positioned in the well to support the vessel brackets; and load monitoring means on the plurality of pedestals between the pedestals and the vessel brackets.

11. A bow dock as in claim 10 wherein the load monitoring means comprise load measuring cells.

12. A bow dock as in claim 10 wherein the means conforming the stern gate to the vessel hull comprise:

an opening in the stern gate;

a stern gate insert positioned in the opening; and an indentation in the stern gate insert which is shaped to fit the vessel hull configuration.

13. A bow dock as in claim 12 wherein the means closing the conforming means comprise an auxiliary gate which is positioned in the stern gate opening.

14. A bow dock as in claim 1 wherein the means forming a seal between the conforming means and the vessel hull comprise a compressible means between the vessel hull and the indentations in the conforming means.

15. A bow dock as in claim 14 wherein the means forming a seal between the conforming means and the vessel hull further comprise an inflatable means between the compressible means and the conforming-means indentations.

16. A bow dock as in claim 1 wherein said stern gate is pivotally mounted on the stern end.

17. A bow dock as in claim 1 wherein said stern gate is slidingly mounted on the stern end.

18. A bow dock providing a dry work space for performing maintenance on the bow of a vessel comprising:

a bottom structure;

a stern end mounted on the bottom structure, said stern end having an aperture for receiving the bow of the vessel;

a bow end mounted on the bottom structure;

port and starboard side members mounted on the bottom structure to form a well with the bow and stern ends;

a stern gate mounted on the stern end comprising:

means conforming the stern gate to the vessel hull, said means being formed with indentations shaped complementarily to the shape of the hull at a predetermined location along the hull, and means forming a seal between the conforming means and the vessel hull;

means mounted on the facing sides of both vessel and dock for controlling both the longitudinal and transverse positions of the vessel within the dock's well, said position-control means being configured to determine the vessel's longitudinal and transverse positions in at least two locations in the well; and means supporting the vessel in the well, said position control means comprising:

a plurality of telescopically adjustable vessel fenders; and a plurality of dock fenders positioned in the well to slidingly engage the vessel fenders.

19. A method of docking a vessel in the well of a bow dock, said vessel being provided with vessel fenders for guiding the vessel into the dock and vessel bracket supports for supporting the vessel in the dock, said bow dock being provided with dock fenders which slidingly engage with the vessel fenders to guide the vessel into the dock, pedestals for supporting the vessel bracket supports, load measuring cells on the pedestals, pivotally mounted intermediate stops and final stops in the well, ballasting, deballasting, flooding and dewatering means, means for moving the vessel and the bow dock together, and a stern gate mounted on the well so as to close the well of the bow dock, said stern gate having means to conform to and seal with the vessel hull configuration and means for sealing the stern gate with the dock, comprising the steps of:

ballasting the dock down to the vessel insertion depth and flooding the well;

opening the stern gate of the bow dock and warping the vessel and the bow dock together to a first position at the intermediate stops, said first position permitting raising of the stern gate without interference with the vessel hull configuration;

closing the stern gate while the vessel is at the intermediate stops;

removing the intermediate stops and warping the vessel and the well together to the final stops;

deballasting the dock until the dock pedestals support the vessel bracket supports and the vessel hull configuration mates with and seals with the stern gate; and dewatering the well to provide a dry work space at the bow of the vessel.

* * * * *